US005965277A

United States Patent [19]

Banthia et al.

[11] Patent Number: 5,965,277

[45] Date of Patent: Oct. 12, 1999

[54] CONCRETE REINFORCING FIBER

[75] Inventors: Nemkumar Banthia, Burnaby; Hugo S. Armelin, Vancouver, both of Canada

[73] Assignee: The University of British Columbia, Vancouver, Canada

[21] Appl. No.: 08/920,352

[22] Filed: Jul. 25, 1997

[51] Int. Cl.[6] ..... E04C 5/03; C04B 14/48

[52] U.S. Cl. ..... 428/574; 428/600; 106/644

[58] Field of Search ..... 428/605, 571, 428/606, 572, 599, 573, 600, 574, 369, 399, 400; 106/644

[56] References Cited

U.S. PATENT DOCUMENTS

| | | | |
|---|---|---|---|
| 1,349,901 | 8/1920 | Meischke-Smith | 106/644 |
| 2,677,955 | 5/1954 | Constantinesco | 106/644 |
| 3,900,667 | 8/1975 | Moens | 106/644 |
| 3,953,953 | 5/1976 | Marsden | 106/644 |
| 4,233,364 | 11/1980 | Van Thiel | 428/399 |
| 4,610,926 | 9/1986 | Tezuka | 428/399 |
| 4,804,585 | 2/1989 | Tani et al. | 106/644 |
| 4,883,713 | 11/1989 | Destree | 428/397 |
| 4,960,649 | 10/1990 | Takata et al. | 106/644 |
| 5,215,830 | 6/1993 | Cinti | 428/606 |
| 5,419,965 | 5/1995 | Hamson | 106/644 |
| 5,443,918 | 8/1995 | Banthia et al. | 428/603 |
| 5,451,741 | 9/1995 | Over et al. | 428/574 |

FOREIGN PATENT DOCUMENTS 2094543 9/1993 Canada .

*Primary Examiner*—John J. Zimmerman
*Attorney, Agent, or Firm*—C. A. Rowley

[57] ABSTRACT

An improved reinforcing fiber for concrete is formed with two types of anchors positioned adjacent to each axial end of the fiber. A drag anchor which frictionally resist being pulled from the concrete without fiber breakage and a dead anchor between the drag anchor and adjacent axial end of the fiber, the dead end engages the concrete to develop stresses at a weakened point in the fiber formed between the drag anchor and its adjacent dead anchor to break the fiber or deform the dead anchor before maximum tensile strength of the fiber is reached so that the dead anchor functions to maximize the load carrying capacity while at the same time protecting against fiber rupture and the drag anchor continues to function after release of the weak point of the fiber.

20 Claims, 6 Drawing Sheets

CONCRETE REINFORCING FIBER

FIELD OF INVENTION

The present invention relates to a reinforcing fiber particularly suited for concrete reinforcing.

BACKGROUND OF THE INVENTION

Concrete is considered a brittle material because of its low tensile strength and strain and thus requires reinforcement for example steel reinforcement rod such as rebar to provide a structural concrete generally known as reinforced concrete.

Another form or method of reinforcing concrete is to form a composite incorporating short fibers such as steel fibers, which typically have a length of approximately 25 mm (1 inch). By dispersing these fibers throughout the concrete, the fracture toughness of the concrete can be increased several times so that the amount of energy consumed prior to rupture is significantly greater. One form of concrete wherein the fiber reinforcing is especially attractive is concrete known as Shotcrete which is a form of concrete having dispersed therein a plurality of fibers that are sprayed together with the cement, water and aggregate to produce a fiber reinforced Shotcrete when the cement sets in situ. Approximately, 50% of the total worldwide steel fiber demand is consumed by Shotcrete.

One of the major problems with steel fibers used in Shotcrete is known as "rebound" which occurs when the dry-mix Shotcrete mixture of cement aggregate and fiber is sprayed or shot into position in that a high proportion of the fibers fails to become embedded in the resultant concrete and thus, are wasted. For example, with commercially available fibers which generally have a diameter of about 0.5 mm (some flat fibers are also used) and a length of about 25 mm as much as 75% of the steel fiber may rebound and not be present in situ in the final concrete.

It is recognized that reinforcing fibers being pulled out of the concrete matrix at cracks is the main mechanism that allows steel fiber reinforced concrete (SFRC) to be more ductile than unreinforced concrete. Thus, all commercial reinforcing fibers presently available in the market, are deformed at the ends or along their length, to enhance the anchorage of the fiber with the concrete matrix and generate a greater pullout resistance.

The state-of-the-art in fiber design may be divided into two large groups with respect to their anchorage mechanisms, namely a "dead anchor" and a "drag anchor".

Dead anchors generally are produced by deforming the fiber with a hook or cone adjacent to each of its ends. Under stress, in an aligned fiber (i.e. under axial tension) the anchor is generally designed to fail (e.g. pullout) at a maximum resistance below the strength of the steel. However, these dead anchors, after failure, have a significantly reduced capacity to resist pullout displacement.

Drag anchors generally are formed by enlarging the fiber adjacent to its end in such a way that during pullout, the enlargement generates friction with the matrix as the fiber is dragged out of the concrete. This type of fiber generally develops a lower maximum pullout resistance as compared to the dead anchor but its effect tends to last for a greater pullout displacement and therefore a greater pullout energy is consumed by the end of the pullout process.

Various types of anchoring mechanism are shown for example in U.S. Pat. No. 4,883,713 issued Nov. 28, 1989 to Destree et al. which shows reinforcing fiber with an expanded head at each axial end of the fiber and U.S. Pat. No. 5,215,830 issued Jun. 1, 1993 to Cinti which shows a metal wire reinforcing fiber with a straight central portion and offset anchoring parts at opposite ends. Canadian patent 2,094,543 published Nov. 9, 1993 inventor Nemegeer which discloses a fiber with hooked ends.

U.S. Pat. No. 5,443,918 issued Aug. 22, 1995 to Banthia et al. discloses a metal fiber for reinforcing cement based material which incorporates sinusoidal shape end portions deformed in a specific manner tailored in accordance with the fiber and matrix properties to obtain the desired composite toughness in the resultant composite.

U.S. Pat. No. 5,451,471 issued Sep. 19, 1995 to Over et al. describes a reinforcement fiber deformed near both of its ends over a selected distance so that a selected amount of the undeformed portion of the fiber is between the deformities. The fibers are also provided with a large number of notches that extend at an angle to the longitudinal axis of the fiber and increase pullout resistance of the fiber when used as reinforcement in the concrete matrix.

BRIEF DESCRIPTION OF THE PRESENT INVENTION

It is an object of the present invention to provide an improved reinforcing fiber for concrete, more particularly, it is an object of the present invention to provide an improved fiber geometry for reinforcing concrete composites formed by shotcreting or casting methods.

Broadly, the present invention relates to a concrete reinforcing fiber comprising a fiber means defining a drag anchor adjacent to but spaced from each axial end of said fiber, means forming a dead anchor between each said means forming said drag anchor and its adjacent axial end of said fiber and a dead anchor release means reducing load carried by said dead anchor when load applied to said fiber develops a stress in said release means that exceeds a selected maximum.

Preferably said dead anchor release means comprises means defining a stress concentration weak point in said fiber between each said dead anchor and its adjacent said drag anchor.

Preferably said weak point is constructed to fail under stress when said fiber is subjected to a load lower than a maximum load carrying capability of said fiber between said stress concentration weak points to release said dead anchor when said fiber between said stress concentration weak points is under a load lower than said maximum load.

Preferably each said dead anchor has a load carrying capability when insitu in concrete lower than said each drag anchor.

Preferably, each said drag anchor is formed by a pair of laterally projecting side flanges projecting one on each of a pair of opposite sides of said fiber by a first distance.

Preferably, said pair of laterally extending side flanges are formed by a deformity in said fiber locally reducing its thickness without producing areas of significant stress concentrations to reduce the axial tensile strength of said fiber.

Preferably, said means defining said dead anchor is formed by a deformity in said fiber reducing its thickness to provide a second pair of laterally projecting side flanges projecting laterally from said fiber by a second distance greater than said first distance.

Preferably, said first and second flanges are positioned in substantially parallel planes.

Preferably, said means defining said weak point is an area of stress concentration formed in said fiber adjacent to where said dead anchor connects to said fiber, at a side of said dead anchor adjacent to its adjacent said drag anchor.

Preferably, said fiber has a ratio fiber length to the square root of fiber diameter of less than 30 mm½.

Preferably, said fiber has a fiber length of between 20 and 35 mm and a fiber diameter of between 0.6 and 1 mm.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Before describing the preferred embodiment of the invention, it must be noted that in the test performed the material used in all of the fibers is steel conventionally used in the manufacture of reinforcing fibers, thus, this disclosure is to be read on the basis that fibers are made from steel or material with equivalent mechanical properties. If a different, but suitable material is to be used the size and shape will have to be modified in accordance with the physical characteristics of the material from which the fibers are made. Obviously, the ductility of the fiber material may render certain materials, in fact many materials, unsuitable for use i.e. materials that are too highly ductile or are too brittle will not be suitable.

As above indicated, the amount of fiber rebound seriously affects the toughness of the reinforced concrete product in that if the fiber rebounds and is no longer retained within the concrete it cannot function to improve the toughness.

A series of experiments were conducted using circular cross section steel fibers having diameters and lengths as follows: diameters, 0.5, 0.61, 0.65, 0.76 and 1 mm and lengths of 3, 12.5, 19, 24.5 and 40 mm. Fibers of each diameter were made to each length. Shotcrete was produced using the dry mix technique and the fiber rebound was evaluated and the in situ fiber content determined. The results obtained are plotted in FIG. 1. Applicants have found that there is a substantially linear relationship between fiber rebound $R_f$ and an aspect ratio given by fiber length divided by the square root of fiber diameter, i.e.

$$R_f = f\, l_f/\phi^{+e,fra}\ 1/2+ee$$

where $R_f$=the fiber rebound $l_f$=fiber length $\phi$=fiber diameter

It will be apparent that a reduction in rebound $R_f$ significantly increases the amount of fiber retained in the concrete produced to the extent that if fiber rebound is reduced from the 75% figure that characterizes the fibers presently in the market to 50%, the in situ fiber content is doubled for the final shotcrete produced.

Figure 1:
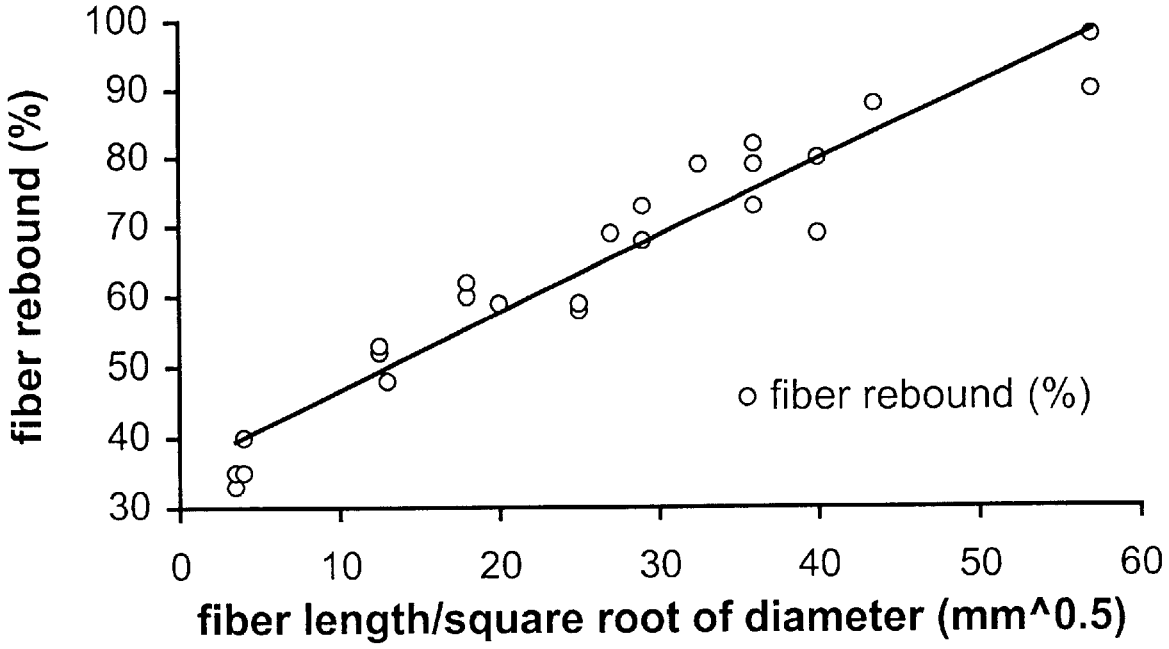
FIG. 1 is a plot of fiber rebound as percent by mass rebounded versus fiber length over the square root of the fiber diameter in millimeters.

As can be seen from FIG. 1, if the fiber rebound is below about 70%, which is less than that of conventional fibers, the ratio of fiber length of the square root of fiber diameter will be below about 30 mm½ (for steel).

Figure 2:
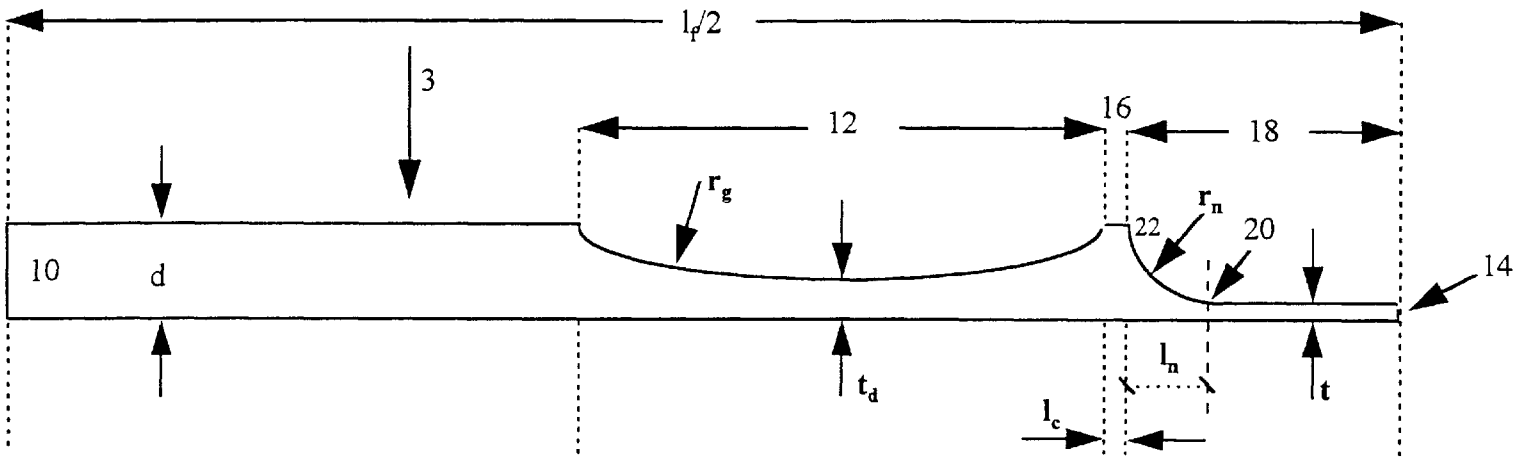
FIG. 2 is a side view of a preferred embodiment of one end of a fiber constructed in accordance with the present invention.
Figure 3:
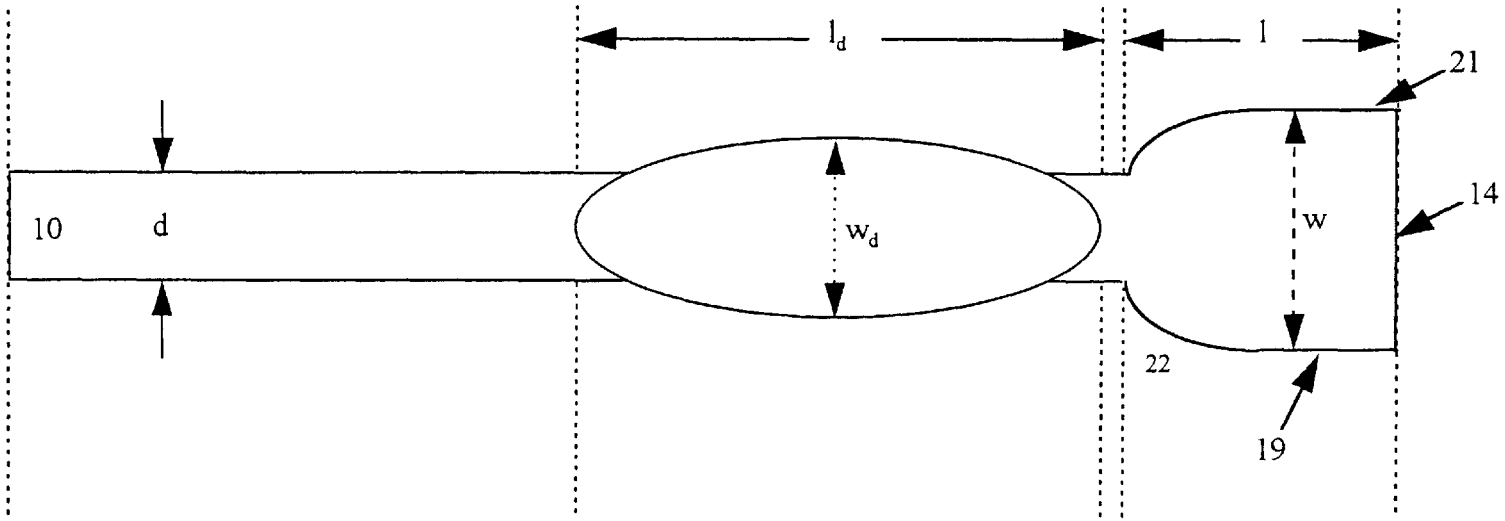
FIG. 3 is a plan view looking at the direction of the arrow 3 in FIG. 2.

FIGS. 2 and 3, show one half (one end) of a preferred fiber constructed in accordance with the present invention i.e. having a preferred fiber geometry. The other half is essentially the same as each fiber is symmetrical on opposite sides of its mid length. As shown, fiber 10 has a diameter d and has a fiber length $l_f$ which in the illustrated arrangement is designated by the dimension $l_f/2$ since only half of the fiber length is shown. The other half of the fiber is essentially the same as that shown in FIGS. 2 and 3.

The fiber is provided with a drag anchor 12 having a length $l_d$ and a width $w_d$ measured at the maximum width of the drag anchor 12. The drag anchor 12 in the illustrated arrangement is a deformity of the fiber diameter to reduce the thickness to $t_d$ by deforming the fiber with a die or the like having a radius $r_g$ which causes the fiber width to be increased in the reduced thickness area to width $w_d$ i.e. width $w_d$ in the drag anchor to be greater than the diameter d of the fiber. While it is preferred to use a die with radius $r_g$ i.e. a circular shape this in not essential, however care must be taken in deforming the fiber not to form areas or zones of high stress under load in the fiber that may cause the fiber to be prematurely broken.

Adjacent to the axial end 14 of the fiber 10 is a connecting section 16 having a length measured in the axial direction of the fiber indicated at $l_c$ ($l_c$ is small relative $l_d$ or and in some cases maybe be zero (0)) and adjacent to and preferably extending from the free end 14 of the fiber 10 to the section 16 is a dead anchor 18 having a length l measured in the axial direction of the fiber and thickness t which is significantly less than the thickness $t_d$ of the drag anchor 12, and a width w significantly wider than the width $w_d$ of the drag section 12.

A stress concentration or weak point 20 which causes a stress concentration and ensures fiber breakage at the stress concentration point under higher than normal loading conditions. This stress concentration point preferably is formed by a neck down section 22 wherein the shape of the fiber is significantly altered to merge into the dead anchor 18 i.e. cross-section of the fiber is significantly flattened and widened (to form the dead anchor which normally will have about the same cross sectional area as the non deformed fiber) over a short length $1_n$ formed in the illustrated arrangement by a fillet having a radius $r_n$ to define a stress concentration or weak point 20 which provides the breaking point across which the fiber is intended to break in use when the fiber is subjected to a sufficiently high load to develop a stress at the stress concentration point 20 above the breaking point. This breakage occurs to render the dead anchor ineffective and thereby lower the stress levels in the fiber.

For the fiber to break at 20 at the appropriate load requires that the dead anchor 18 provides sufficient resistance to force being pulled out of the concrete to generate a stress in the fiber higher than can be accommodated by the weak point 20 i.e. the stress at 20 becomes so high that the fiber breaks in the area 20. Thus, the thickness t and width w which in effect generate the gripping power of the dead anchor 18 in the fiber 10 as illustrated must develop sufficient friction or binding with the concrete so that a pulling force required to generate the stress at the stress concentration point 20 sufficiently high to break the fiber at the weak point 20 may be applied axially in the fiber between the drag 12 and dead anchors 18.

In some cases the flanges or lateral projections 19 and 21 of the dead anchor 18 on opposite sides of the fiber tend to buckle or fold which reduces the resistance to slippage of the dead anchor 18 and renders the dead anchor 18 less effective to carry a high load so that maximum load carrying ability in these cases is reduced by buckling of the dead anchor 18 to reduce the load on the fiber.

Thus the objective of the invention of ensuring the dead anchor releases to reduce the stress in the fiber may be attained in at least two ways namely by designing the fiber to break at a stress concentration point 20 between the dead 18 and the drag anchors 12 and/or by causing the dead anchor 18 itself to deform and release.

The geometry of the dead anchor 18 that permits it to release by deformation of the dead anchor at a peak load before breakage at the weak point 20 (if a weak point 20 is provided) and in any event to reduce stress in the fiber, for the design shown in FIGS. 2 and 3, is primarily dependent on the thickness t of the dead anchor 18.

While as above indicated the stress concentration or weak point 20 may not be the governing factor causing release of the dead anchor it is preferred to include such a point in the fiber design as it may be more accurately designed to ensure stress relief to the fiber under the appropriate load conditions. The load carrying capacity of the fiber between the stress concentrating weak points 20 is not exceeded when the fiber breaks at the stress concentrating weak point(s) 20.

Figure 4:
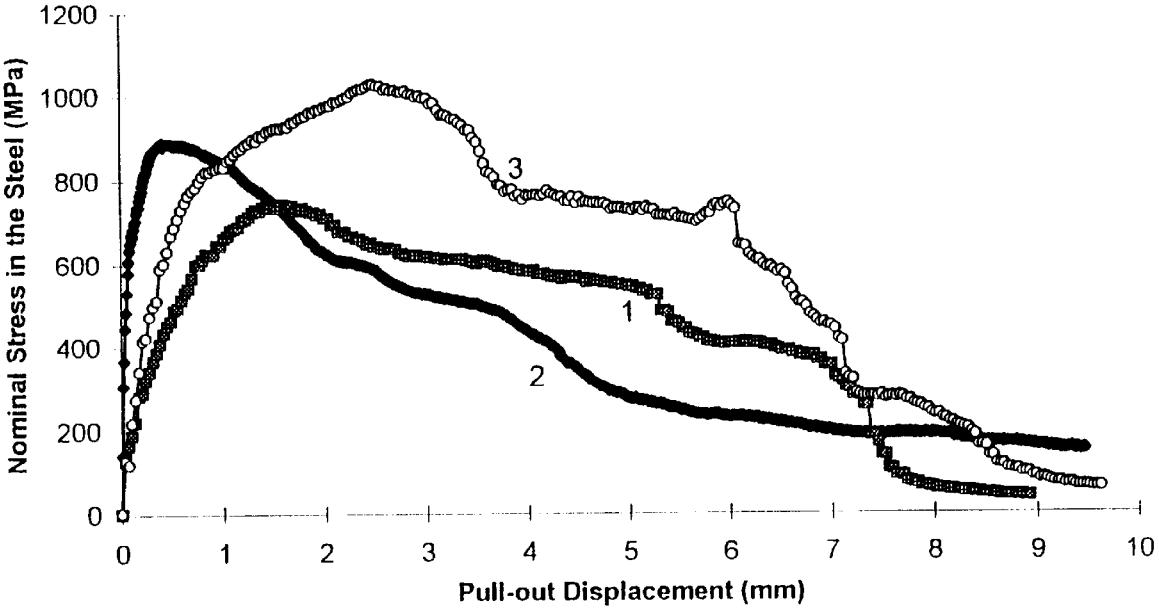
FIG. 4 is a plot of the pullout displacement versus nominal stress in the steel for a commercially available fiber having only a dead anchor, a commercially available fiber having only a drag anchor and for a fiber having a combination of dead and drag anchors constructed in accordance with the preferred embodiment of the present invention.

The drag anchor 12 functions in essentially the same way as a conventional drag anchor in conventional reinforcing fiber. However, the maximum drag force or axial force applied to the fiber 10 in order to permit the drag anchor to be dragged through the concrete is less than the maximum force necessary to break the fiber 10. The incremental added forces that are carried by the dead anchor 18 under peak conditions cause the stress at the weak point 20 to break the fiber at the weak point 20 or the stresses in the dead anchor to deform the dead anchor 18 and cause it to release. Thus the dead anchor 18 functions to reinforce the concrete in one case until breaking occurs at 20 or in the second case until the dead anchor is deformed. In either case as shown in FIG. 4, the energy that can be absorbed by the fiber is substantially greater than can be absorbed using conventional reinforcing fibers with conventional anchor structures. This system permits the application of a higher total pull out load without risk of fiber breakage as the dead anchor releases before the stress in the remainder of the fiber including the drag anchor exceeds its modulus of rupture.

Generally, the drag anchor 12 will be designed to carry at least 80% of the peak load and preferably 90% or higher so that the incremental load carried by the dead anchor is small and the carrying capacity of the fiber is not reduced dramatically when the dead anchor is released.

FIG. 4 shows the effectiveness of the present invention in improving the energy absorption that can be obtained from individual fibers having the anchor of the present invention relative to individual commercially available fibers with anchors. The commercial fiber having only a drag anchor (curve 1 in FIG. 4) provides a relatively gradual increase in stress as the displacement (pullout) is increased to about 1.5 mm. When a fiber with only a dead anchor was tested (curve 2 in FIG. 4) the peak or maximum stress that can be applied is significantly higher, approximately 900 MPa. (tensile strength of the steel used in all cases is 1100 MPa), but the displacement that can be tolerated is less than approximately ½ mm. In both cases, the nominal fiber stress quickly diminishes (more so for the dead anchor than the drag anchor) as displacement is increased beyond the point of peak stress.

The fiber having the combination of the dead and drag anchors 18 and 12 of the present invention, (curve 3 of FIG. 4) shows a very significant increase in stress that can be tolerated i.e. the nominal stress for the fiber reaches above 1000 MPa while accommodating a displacement of about 2½ mm. and then the allowable stress drops off but does not reduce to that of the commercial drag anchor per se until a very substantial amount of pullout has taken place, i.e. in the order of about 7 mm. The weak point 20 fractures or the dead anchor 18 is deformed to release the dead anchor when the peak stress is attained which occurs before the rupture strength of the fiber is reached thereby preventing the fiber rupturing load from being applied to the fiber.

It will be apparent from FIG. 4 that the energy absorbed using the present invention of the combination of the dead and drag anchors (curve 3) is able to absorb significantly more energy than either one of the two prior art anchors (curves 1 or 2) (the energy absorbed is measured by the area under their respective curves). Thus it is apparent that significant improvements in amount of pull out energy that can be absorbed is obtainable using the present invention.

EXAMPLE

Figure 5:
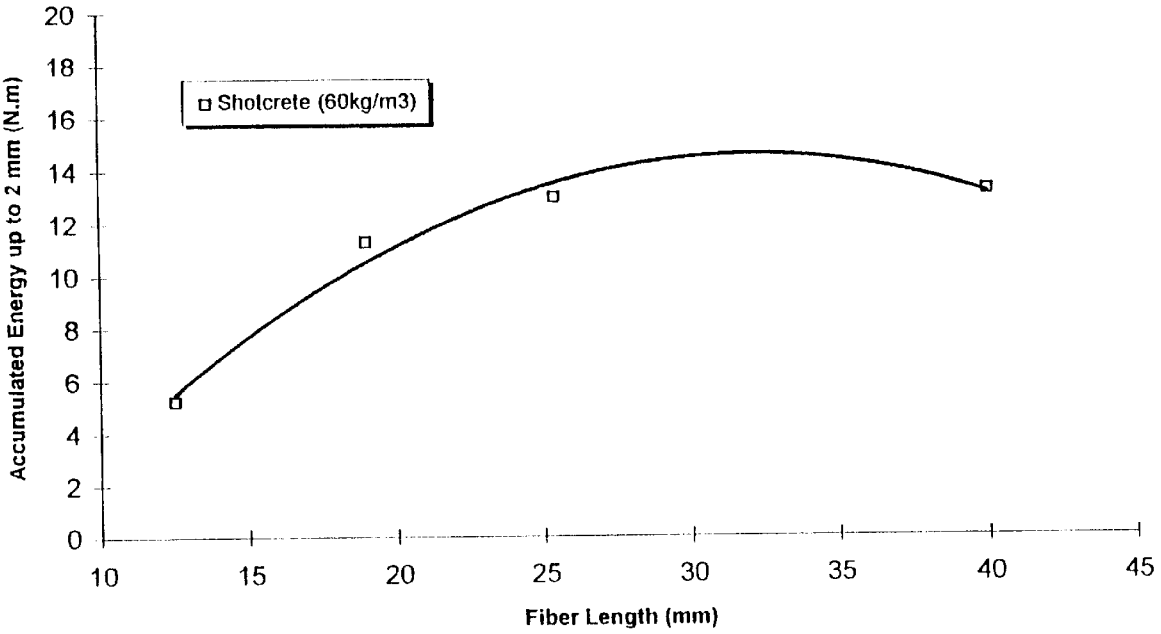
FIG. 5 is a plot of fiber length versus shotcrete fracture energy for four different lengths of fiber constructed in accordance with the present invention.

To optimize the present invention, fibers were made from a fixed diameter wire with a 0.89 mm diameter formed with lengths of 12.5, 19, 25.4 and 40 mm and all were tested at the rate of 60 kg/m$^3$ in shotcrete to determine their accumulated fracture energy under flexural loading of a standard ASTM C1018 test on beam specimens 100×100×350 mm. (area under the flexural load versus displacement curve to a displacement of 2 mm). The results obtained are plotted in FIG. 5 where it is apparent that a fiber length of somewhere between 20 to 40 mm, preferably about 25 mm, was found to be optimum.

Figure 6:
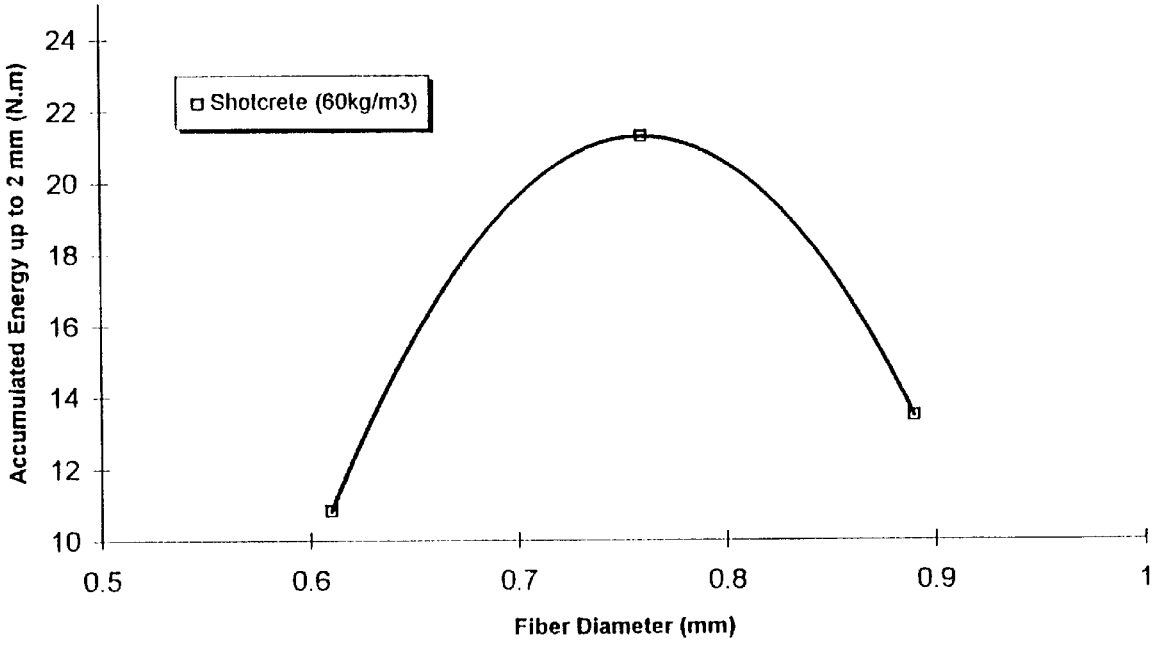
FIG. 6 is a plot of fiber diameter versus shotcrete fracture energy for three different diameter fibers of the present invention.

Next, after selecting an optimum length of 25.4 mm, fibers of diameters of 0.61, 0.76 and 0.89 were tested. The results of these tests are shown in FIG. 6, where it is clearly indicated that a fiber diameter of about 0.75 mm (0.74 to 0.8 mm) was optimum.

Based on these dimensions, namely, a length $l_f$=25.4 mm and a diameter d=0.76 mm, the dimensions of the fiber illustrated in FIGS. 2 and 3 were optimized. In this arrangement, the diameter $r_g$ of the indentation forming the drag section 12 was 10.7 mm, the thickness $t_d$ was about 0.46 times diameter d, the width $w_d$ was 1.45 times the diameter d.

Based on the dimensions $r_g$ and $t_d$ the length $l_d$ may be derived.

The length l of the dead hook section was set at 1.4 the diameter d of the fiber and the thickness t was 0.23 times the diameter d which produce a width w of 2.36 times the diameter. The dimension $l_c$ was 0.2 mm and $l_n$ and radius $r_n$ for this example were equal and less than 0.5 mm.

In other words, in one of the preferred embodiments of the present invention for Shotcrete uses a fiber diameter of 0.76 mm, thickness $t_d$ of 0.35 mm, width $w_d$ of 1.1 mm, thickness t of 0.18 mm and width w of 1.79 mm.

EXAMPLE 2

Figure 7:
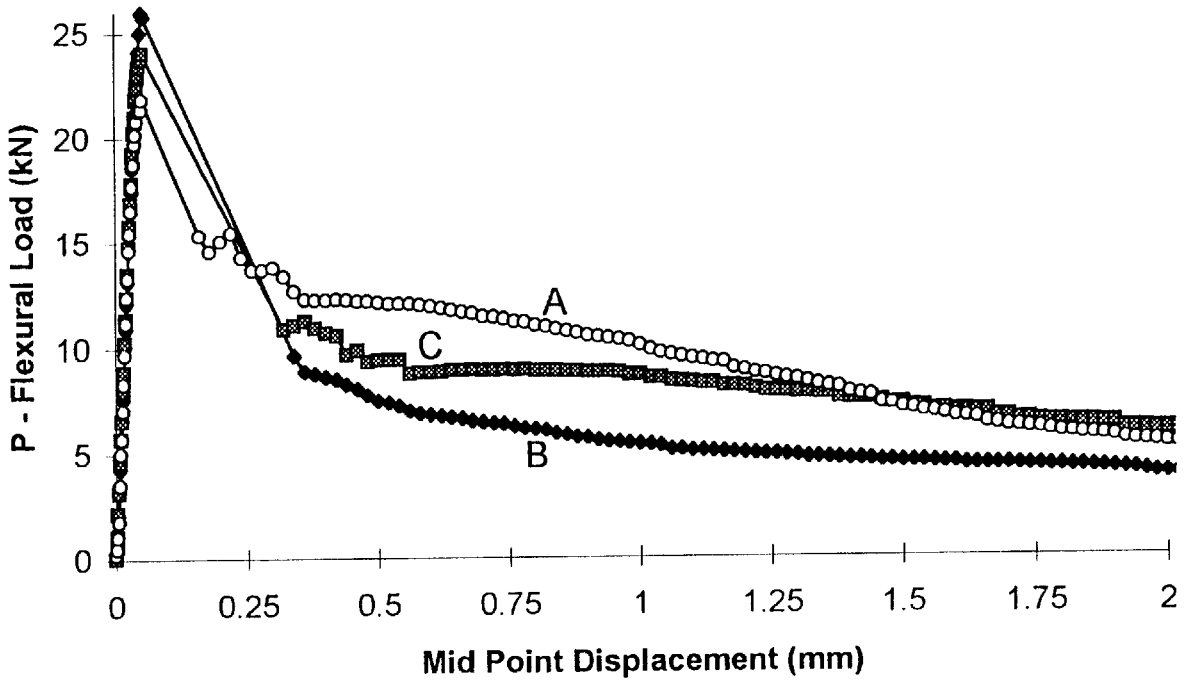
FIG. 7 is a plot of load vs. displacement in flexural toughness testing (ASTM C1018) comparing shotcrete made using the two different types of commercial fibers used in the tests plotted in FIG. 4 with shotcrete made with fibers constructed in accordance with the present invention (average of at least 4 tests).

Fibers as described in the above example were produced in sufficient quantity and tested in a Shotcrete application and compared using standard ASTM C1018 test with 100×100×350 mm. 5 specimens under flexural testing with commercial fibers were used for the same application. The results of these tests are plotted in FIG. 7 wherein curve A is a plot of the results obtained using the present invention and curve B was obtained using fibers sold under the tradename Dramix by Bekaert and curve C using FE fiber sold by Novocon. It is apparent that the present invention is able to accommodate more load carrying capacity and therefore consume more fracture energy (the area contained by the curves in FIG. 7) than either of the two commercial products.

The above description has been directed primarily to Shotcrete applications as they are more complicated in that fiber rebound plays a roll, however the present invention may also be used with cast concrete. Fibers for use in cast concrete may for example have significantly longer length than that of fibers for Shotcrete in fact the length may be about doubled.

Having described the invention, modifications will be evident to those skilled in the art without departing from the scope of the invention as defined in the appended claims.

We claim:

1. A concrete reinforcing fiber comprising a fiber having a maximum load carrying capability, means defining a drag anchor adjacent to but spaced from each axial end of said fiber, means forming a dead anchor between each said means forming said drag anchor and its adjacent axial end of said fiber and a dead anchor release which reduces load carried by said dead anchor when an applied load less than said maximum load carrying capability is applied to said fiber and which applied load develops a stress in said dead anchor release that exceeds a preselected stress.

2. A concrete reinforcing fiber as defined in claim 1 wherein said dead anchor release comprises means defining a stress concentration weak point in said fiber between each said dead anchor and its adjacent said drag anchor.

3. A concrete reinforcing fiber as defined in claim 2 wherein said weak point is constructed to fail under said stress to release said dead anchor when said fiber is under said applied load lower than said maximum load carrying capability of said fiber.

4. A concrete reinforcing fiber as defined in claim 1 wherein each said dead anchor has a load carrying capability when in situ in concrete lower than said each drag anchor.

5. A concrete reinforcing fiber as defined in claim 2 wherein each said dead anchor has a load carrying capability when in situ in concrete lower than said each drag anchor.

6. A concrete reinforcing fiber as defined in claim 3 wherein each said dead anchor has a load carrying capability when in situ in concrete lower than said each drag anchor.

7. A concrete reinforcing fiber as defined in claim 2 wherein said means defining said stress concentration weak point is an area of stress concentration formed in said fiber adjacent to where said dead anchor connects to said fiber, at a side of said dead anchor adjacent to it adjacent said drag anchor.

8. A concrete reinforcing fiber as defined in claim 3 wherein said means defining said stress concentration weak point is an area of stress concentration formed in said fiber adjacent to where said dead anchor connects to said fiber, at a side of said dead anchor adjacent to it adjacent said drag anchor.

9. A concrete reinforcing fiber as defined in claim 2 wherein each said drag anchor is formed by pair of laterally projecting side flanges projecting one on each of a pair of opposite sides of said fiber by a first distance.

10. A concrete reinforcing fiber as defined in claim 9 wherein said pair of laterally extending side flanges are formed by a deformity in said fiber locally reducing its thickness without producing areas of significant stress concentrations that reduce the axial tensile strength of said fiber.

11. A concrete reinforcing fiber as defined in claim 9 wherein said means defining said dead anchor is formed by a deformity in said fiber reducing its thickness to provide a second pair of laterally projecting side flanges projecting laterally from said fiber by a second distance greater than said first distance.

12. A concrete reinforcing fiber as defined in claim 11 wherein said first and second flanges are positioned in substantially parallel planes.

13. A concrete reinforcing fiber as defined in claim 3 wherein each said drag anchor is formed by pair of laterally projecting side flanges projecting one on each of a pair of opposite sides of said fiber by a first distance.

14. A concrete reinforcing fiber as defined in claim 13 wherein said pair of laterally extending side flanges are formed by a deformity in said fiber locally reducing its thickness without producing areas of significant stress concentrations that reduce the axial tensile strength of said fiber.

15. A concrete reinforcing fiber as defined in claim 14 wherein said means defining said dead anchor is formed by a deformity in said fiber reducing its thickness to provide a second pair of laterally projecting side flanges projecting laterally from said fiber by a second distance greater than said first distance.

16. A concrete reinforcing fiber as defined in claim 15 wherein said first and second flanges are positioned in substantially parallel planes.

17. A concrete reinforcing fiber as defined in claim 1 wherein said fiber has a fiber length of between 20 and 35 mm and a fiber diameter of between 0.6 and 1 mm.

18. A concrete reinforcing fiber as defined in claim 1 wherein each said drag anchor is formed by pair of laterally projecting side flanges projecting one on each of a pair of opposite sides of said fiber by a first distance.

19. A concrete reinforcing fiber as defined in claim 18 wherein said pair of laterally extending side flanges are formed by a deformity in said fiber locally reducing its thickness without producing areas of significant stress concentrations that reduce the axial tensile strength of said fiber.

20. A concrete reinforcing fiber as defined in claim 2 wherein said fiber has a fiber length of between 20 and 35 mm and a fiber diameter of between 0.6 and 1 mm.

* * * * *